US007956874B2

(12) United States Patent
Seong et al.

(10) Patent No.: US 7,956,874 B2
(45) Date of Patent: Jun. 7, 2011

(54) DISPLAY APPARATUS AND CONTROL METHOD THEREOF

(75) Inventors: Hwa-seok Seong, Suwon-si (KR); Young-sun Kim, Suwon-si (KR); Jong-sul Min, Hwasung-si (KR); Ho-seop Lee, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1364 days.

(21) Appl. No.: 11/100,458

(22) Filed: Apr. 7, 2005

(65) Prior Publication Data

US 2005/0225565 A1 Oct. 13, 2005

(30) Foreign Application Priority Data

Apr. 9, 2004 (KR) ..... 10-2004-0024565

(51) Int. Cl.
*G09G 5/10* (2006.01)

(52) U.S. Cl. ..... 345/690; 345/593; 345/596; 345/204; 345/63; 345/89

(58) Field of Classification Search ..... 345/596, 345/599, 613, 616, 593; 382/169, 274
See application file for complete search history.

(56) References Cited

U.S. PATENT DOCUMENTS 6,340,961 B1 * 1/2002 Tanaka et al. ..... 345/63
6,476,875 B2 * 11/2002 Correa et al. ..... 348/607
6,965,358 B1 * 11/2005 Kasahara et al. ..... 345/63
7,256,794 B2 * 8/2007 Myoung et al. ..... 345/596
7,499,062 B2 * 3/2009 Yamada ..... 345/690
2001/0028347 A1 * 10/2001 Kawahara et al. ..... 345/204
2002/0060737 A1 * 5/2002 Hsieh et al. ..... 348/208
2003/0151565 A1 * 8/2003 Kim et al. ..... 345/60

FOREIGN PATENT DOCUMENTS

| | | | |
|---|---|---|---|
| JP | 11-8769 | | 1/1999 |
| JP | 2000-155561 | | 6/2000 |
| JP | 2000-276100 | | 10/2000 |
| JP | 2003-69922 | | 3/2003 |
| KR | 2003-0081151 | | 10/2003 |
| KR | 10-0420789 | | 3/2004 |
| WO | WO 00/43979 | * | 7/2000 |

OTHER PUBLICATIONS

Japanese Office Action dated Apr. 8, 2008 issued in JP 2005-111212.

* cited by examiner

*Primary Examiner* — Kee M Tung
*Assistant Examiner* — Jwalant Amin
(74) *Attorney, Agent, or Firm* — Stanzione & Kim, LLP

(57) ABSTRACT

A display apparatus that displays a picture based on a video signal, including a moving picture determiner that determines whether the video signal is used for displaying a moving picture; a moving picture gradation level table that stores information about a moving picture gradation level group for displaying the moving picture; a still picture gradation level table storing information about a still picture gradation level group including a predetermined number of gradation levels in consideration of a gradation level difference between the gradation levels of adjacent gradation levels in the case where the gradation level difference between the adjacent gradation levels of the moving picture gradation level group is larger than a predetermined reference gradation level difference; and a gradation level converter that converts the video signal to have the gradation level of the moving picture gradation level group or the still picture gradation level group according to results of the determination. With this configuration, a false contour is attenuated and a flicker is avoided in a moving picture.

28 Claims, 6 Drawing Sheets

| SUB-FIELD | SF1 | SF2 | SF3 | SF4 | SF5 | SF6 | SF7 | SF8 | USING SINGLE-DIGIT CODE LEVEL | OTHER SINGLE-DIGIT CODE LEVEL | OTHER VALUE |
|---|---|---|---|---|---|---|---|---|---|---|---|
| SUSTAINING PULSE / GRADATION LEVEL | 1 | 2 | 4 | 8 | 16 | 32 | 64 | 128 | | | |
| 30 | 0 | 1 | 1 | 1 | 1 | 0 | 0 | 0 | | | |
| 31 | 1 | 1 | 1 | 1 | 1 | 0 | 0 | 0 | ● | | |
| 32 | 0 | 0 | 0 | 0 | 0 | 1 | 0 | 0 | | | |
| 33 | 1 | 0 | 0 | 0 | 0 | 1 | 0 | 0 | | | |
| 34 | 0 | 1 | 0 | 0 | 0 | 1 | 0 | 0 | | ● | 1 |
| 35 | 1 | 1 | 0 | 0 | 0 | 1 | 0 | 0 | | | |
| 36 | 0 | 0 | 1 | 0 | 0 | 1 | 0 | 0 | | | |
| 37 | 1 | 0 | 1 | 0 | 0 | 1 | 0 | 0 | | ● | 2 |
| 38 | 0 | 1 | 1 | 0 | 0 | 1 | 0 | 0 | | | |
| 39 | 1 | 1 | 1 | 0 | 0 | 1 | 0 | 0 | | | |
| 40 | 0 | 0 | 0 | 1 | 0 | 1 | 0 | 0 | | ● | 3 |
| 41 | 1 | 0 | 0 | 1 | 0 | 1 | 0 | 0 | | | |
| 42 | 0 | 1 | 0 | 1 | 0 | 1 | 0 | 0 | | | |
| 43 | 1 | 1 | 0 | 1 | 0 | 1 | 0 | 0 | | ● | 4 |
| 44 | 0 | 0 | 1 | 1 | 0 | 1 | 0 | 0 | | | |
| 45 | 1 | 0 | 1 | 1 | 0 | 1 | 0 | 0 | | | |
| 46 | 0 | 1 | 1 | 1 | 0 | 1 | 0 | 0 | | ● | 5 |
| 47 | 1 | 1 | 1 | 1 | 0 | 1 | 0 | 0 | | | |
| 48 | 0 | 0 | 0 | 0 | 1 | 1 | 0 | 0 | | | |
| 49 | 1 | 0 | 0 | 0 | 1 | 1 | 0 | 0 | | ● | 6 |
| 50 | 0 | 1 | 0 | 0 | 1 | 1 | 0 | 0 | | | |
| 51 | 1 | 1 | 0 | 0 | 1 | 1 | 0 | 0 | | | |
| 52 | 0 | 0 | 1 | 0 | 1 | 1 | 0 | 0 | | ● | 7 |
| 53 | 1 | 0 | 1 | 0 | 1 | 1 | 0 | 0 | | | |
| 54 | 0 | 1 | 1 | 0 | 1 | 1 | 0 | 0 | | | |
| 55 | 1 | 1 | 1 | 0 | 1 | 1 | 0 | 0 | | ● | 8 |
| 56 | 0 | 0 | 0 | 1 | 1 | 1 | 0 | 0 | | | |
| 57 | 1 | 0 | 0 | 1 | 1 | 1 | 0 | 0 | | | |
| 58 | 0 | 1 | 0 | 1 | 1 | 1 | 0 | 0 | | ● | 9 |
| 59 | 1 | 1 | 0 | 1 | 1 | 1 | 0 | 0 | | | |
| 60 | 0 | 0 | 1 | 1 | 1 | 1 | 0 | 0 | | | |
| 61 | 1 | 0 | 1 | 1 | 1 | 1 | 0 | 0 | | ● | 10 |
| 62 | 0 | 1 | 1 | 1 | 1 | 1 | 0 | 0 | | | |
| 63 | 1 | 1 | 1 | 1 | 1 | 1 | 0 | 0 | ● | | |

FIG. 2

| SUB-FIELD / GRADATION LEVEL | sf1 | sf2 | sf3 | sf4 | sf5 | sf6 | sf7 | sf8 | USING GRADATION LEVEL | EITHER GRADATION LEVEL | DITHER VALUE |
|---|---|---|---|---|---|---|---|---|---|---|---|
| | 1 | 2 | 4 | 8 | 16 | 32 | 64 | 128 | | | |
| 0 | 0 | 0 | 0 | 0 | 0 | 0 | 0 | 0 | ● | | |
| 1 | 1 | 0 | 0 | 0 | 0 | 0 | 0 | 0 | ● | | |
| 2 | 0 | 1 | 0 | 0 | 0 | 0 | 0 | 0 | | ● | 1 |
| 3 | 1 | 1 | 0 | 0 | 0 | 0 | 0 | 0 | ● | | |
| 4 | 0 | 0 | 1 | 0 | 0 | 0 | 0 | 0 | | | |
| 5 | 1 | 0 | 1 | 0 | 0 | 0 | 0 | 0 | | ● | 2 |
| 6 | 0 | 1 | 1 | 0 | 0 | 0 | 0 | 0 | | | |
| 7 | 1 | 1 | 1 | 0 | 0 | 0 | 0 | 0 | ● | | |
| 8 | 0 | 0 | 0 | 1 | 0 | 0 | 0 | 0 | | | |
| 9 | 1 | 0 | 0 | 1 | 0 | 0 | 0 | 0 | | | |
| 10 | 0 | 1 | 0 | 1 | 0 | 0 | 0 | 0 | | | |
| 11 | 1 | 1 | 0 | 1 | 0 | 0 | 0 | 0 | | ● | 4 |
| 12 | 0 | 0 | 1 | 1 | 0 | 0 | 0 | 0 | | | |
| 13 | 1 | 0 | 1 | 1 | 0 | 0 | 0 | 0 | | | |
| 14 | 0 | 1 | 1 | 1 | 0 | 0 | 0 | 0 | | | |
| 15 | 1 | 1 | 1 | 1 | 0 | 0 | 0 | 0 | ● | | |
| 16 | 0 | 0 | 0 | 0 | 1 | 0 | 0 | 0 | | | |
| 17 | 1 | 0 | 0 | 0 | 1 | 0 | 0 | 0 | | | |
| 18 | 0 | 1 | 0 | 0 | 1 | 0 | 0 | 0 | | | |
| 19 | 1 | 1 | 0 | 0 | 1 | 0 | 0 | 0 | | | |
| 20 | 0 | 0 | 1 | 0 | 1 | 0 | 0 | 0 | | | |
| 21 | 1 | 0 | 1 | 0 | 1 | 0 | 0 | 0 | | | |
| 22 | 0 | 1 | 1 | 0 | 1 | 0 | 0 | 0 | | | |
| 23 | 1 | 1 | 1 | 0 | 1 | 0 | 0 | 0 | | ● | 8 |
| 24 | 0 | 0 | 0 | 1 | 1 | 0 | 0 | 0 | | | |
| 25 | 1 | 0 | 0 | 1 | 1 | 0 | 0 | 0 | | | |
| 26 | 0 | 1 | 0 | 1 | 1 | 0 | 0 | 0 | | | |
| 27 | 1 | 1 | 0 | 1 | 1 | 0 | 0 | 0 | | | |
| 28 | 0 | 0 | 1 | 1 | 1 | 0 | 0 | 0 | | | |
| 29 | 1 | 0 | 1 | 1 | 1 | 0 | 0 | 0 | | | |
| 30 | 0 | 1 | 1 | 1 | 1 | 0 | 0 | 0 | | | |
| 31 | 1 | 1 | 1 | 1 | 1 | 0 | 0 | 0 | ● | | |
| 32 | 0 | 0 | 0 | 0 | 0 | 1 | 0 | 0 | | | |
| 33 | 1 | 0 | 0 | 0 | 0 | 1 | 0 | 0 | | | |
| 34 | 0 | 1 | 0 | 0 | 0 | 1 | 0 | 0 | | | |
| 35 | 1 | 1 | 0 | 0 | 0 | 1 | 0 | 0 | | | |
| 36 | 0 | 0 | 1 | 0 | 0 | 1 | 0 | 0 | | | |
| 37 | 1 | 0 | 1 | 0 | 0 | 1 | 0 | 0 | | | |
| 38 | 0 | 1 | 1 | 0 | 0 | 1 | 0 | 0 | | | |
| 39 | 1 | 1 | 1 | 0 | 0 | 1 | 0 | 0 | | | |
| 40 | 0 | 0 | 0 | 1 | 0 | 1 | 0 | 0 | | | |
| 41 | 1 | 0 | 0 | 1 | 0 | 1 | 0 | 0 | | | |
| 42 | 0 | 1 | 0 | 1 | 0 | 1 | 0 | 0 | | | |
| 43 | 1 | 1 | 0 | 1 | 0 | 1 | 0 | 0 | | | |
| 44 | 0 | 0 | 1 | 1 | 0 | 1 | 0 | 0 | | | |
| 45 | 1 | 0 | 1 | 1 | 0 | 1 | 0 | 0 | | | |
| 46 | 0 | 1 | 1 | 1 | 0 | 1 | 0 | 0 | | | |
| 47 | 1 | 1 | 1 | 1 | 0 | 1 | 0 | 0 | | ● | 16 |
| 48 | 0 | 0 | 0 | 0 | 1 | 1 | 0 | 0 | | | |
| 49 | 1 | 0 | 0 | 0 | 1 | 1 | 0 | 0 | | | |
| 50 | 0 | 1 | 0 | 0 | 1 | 1 | 0 | 0 | | | |
| 51 | 1 | 1 | 0 | 0 | 1 | 1 | 0 | 0 | | | |
| 52 | 0 | 0 | 1 | 0 | 1 | 1 | 0 | 0 | | | |
| 53 | 1 | 0 | 1 | 0 | 1 | 1 | 0 | 0 | | | |
| 54 | 0 | 1 | 1 | 0 | 1 | 1 | 0 | 0 | | | |
| 55 | 1 | 1 | 1 | 0 | 1 | 1 | 0 | 0 | | | |
| 56 | 0 | 0 | 0 | 1 | 1 | 1 | 0 | 0 | | | |
| 57 | 1 | 0 | 0 | 1 | 1 | 1 | 0 | 0 | | | |
| 58 | 0 | 1 | 0 | 1 | 1 | 1 | 0 | 0 | | | |
| 59 | 1 | 1 | 0 | 1 | 1 | 1 | 0 | 0 | | | |
| 60 | 0 | 0 | 1 | 1 | 1 | 1 | 0 | 0 | | | |
| 61 | 1 | 0 | 1 | 1 | 1 | 1 | 0 | 0 | | | |
| 62 | 0 | 1 | 1 | 1 | 1 | 1 | 0 | 0 | | | |
| 63 | 1 | 1 | 1 | 1 | 1 | 1 | 0 | 0 | ● | | |

FIG. 3

| | SF1 | SF2 | SF3 | SF4 | SF5 | SF6 | SF7 | SF8 |
|---|---|---|---|---|---|---|---|---|
| SUSTAINING PULSE / GRADATION LEVEL | 1 | 2 | 4 | 8 | 16 | 32 | 64 | 128 |
| 0 | 0 | 0 | 0 | 0 | 0 | 0 | 0 | 0 |
| 1 | 1 | 0 | 0 | 0 | 0 | 0 | 0 | 0 |
| 3 | 1 | 1 | 0 | 0 | 0 | 0 | 0 | 0 |
| 7 | 1 | 1 | 1 | 0 | 0 | 0 | 0 | 0 |
| 15 | 1 | 1 | 1 | 1 | 0 | 0 | 0 | 0 |
| 31 | 1 | 1 | 1 | 1 | 1 | 0 | 0 | 0 |
| 63 | 1 | 1 | 1 | 1 | 1 | 1 | 0 | 0 |
| 127 | 1 | 1 | 1 | 1 | 1 | 1 | 1 | 0 |
| 255 | 1 | 1 | 1 | 1 | 1 | 1 | 1 | 1 |

FIG. 5

| SUB-FIELD | SF1 | SF2 | SF3 | SF4 | SF5 | SF6 | SF7 | SF8 | USING GRADATION LEVEL | DITHER GRADATION LEVEL | DITHER VALUE |
|---|---|---|---|---|---|---|---|---|---|---|---|
| SUSTAINING PULSE / GRADATION LEVEL | 1 | 2 | 4 | 8 | 16 | 32 | 64 | 128 | | | |
| 30 | 0 | 1 | 1 | 1 | 1 | 0 | 0 | 0 | | | |
| 31 | 1 | 1 | 1 | 1 | 1 | 0 | 0 | 0 | ● | | |
| 32 | 0 | 0 | 0 | 0 | 0 | 1 | 0 | 0 | | | |
| 33 | 1 | 0 | 0 | 0 | 0 | 1 | 0 | 0 | | | |
| 34 | 0 | 1 | 0 | 0 | 0 | 1 | 0 | 0 | | ● | 1 |
| 35 | 1 | 1 | 0 | 0 | 0 | 1 | 0 | 0 | | | |
| 36 | 0 | 0 | 1 | 0 | 0 | 1 | 0 | 0 | | | |
| 37 | 1 | 0 | 1 | 0 | 0 | 1 | 0 | 0 | | ● | 2 |
| 38 | 0 | 1 | 1 | 0 | 0 | 1 | 0 | 0 | | | |
| 39 | 1 | 1 | 1 | 0 | 0 | 1 | 0 | 0 | | | |
| 40 | 0 | 0 | 0 | 1 | 0 | 1 | 0 | 0 | | ● | 3 |
| 41 | 1 | 0 | 0 | 1 | 0 | 1 | 0 | 0 | | | |
| 42 | 0 | 1 | 0 | 1 | 0 | 1 | 0 | 0 | | | |
| 43 | 1 | 1 | 0 | 1 | 0 | 1 | 0 | 0 | | ● | 4 |
| 44 | 0 | 0 | 1 | 1 | 0 | 1 | 0 | 0 | | | |
| 45 | 1 | 0 | 1 | 1 | 0 | 1 | 0 | 0 | | | |
| 46 | 0 | 1 | 1 | 1 | 0 | 1 | 0 | 0 | | ● | 5 |
| 47 | 1 | 1 | 1 | 1 | 0 | 1 | 0 | 0 | | | |
| 48 | 0 | 0 | 0 | 0 | 1 | 1 | 0 | 0 | | | |
| 49 | 1 | 0 | 0 | 0 | 1 | 1 | 0 | 0 | | ● | 6 |
| 50 | 0 | 1 | 0 | 0 | 1 | 1 | 0 | 0 | | | |
| 51 | 1 | 1 | 0 | 0 | 1 | 1 | 0 | 0 | | | |
| 52 | 0 | 0 | 1 | 0 | 1 | 1 | 0 | 0 | | ● | 7 |
| 53 | 1 | 0 | 1 | 0 | 1 | 1 | 0 | 0 | | | |
| 54 | 0 | 1 | 1 | 0 | 1 | 1 | 0 | 0 | | | |
| 55 | 1 | 1 | 1 | 0 | 1 | 1 | 0 | 0 | | ● | 8 |
| 56 | 0 | 0 | 0 | 1 | 1 | 1 | 0 | 0 | | | |
| 57 | 1 | 0 | 0 | 1 | 1 | 1 | 0 | 0 | | | |
| 58 | 0 | 1 | 0 | 1 | 1 | 1 | 0 | 0 | | ● | 9 |
| 59 | 1 | 1 | 0 | 1 | 1 | 1 | 0 | 0 | | | |
| 60 | 0 | 0 | 1 | 1 | 1 | 1 | 0 | 0 | | | |
| 61 | 1 | 0 | 1 | 1 | 1 | 1 | 0 | 0 | | ● | 10 |
| 62 | 0 | 1 | 1 | 1 | 1 | 1 | 0 | 0 | | | |
| 63 | 1 | 1 | 1 | 1 | 1 | 1 | 0 | 0 | ● | | |

DISPLAY APPARATUS AND CONTROL METHOD THEREOF

CROSS-REFERENCE TO RELATED APPLICATIONS

This application claims the benefit of Korean Patent Application No. 2004-24565, filed 9 Apr. 2004, in the Korean Intellectual Property Office, the disclosure of which is incorporated herein by reference.

BACKGROUND OF THE INVENTION

1. Field of the Invention

The present general inventive concept relates to a display apparatus and a control method thereof, and more particularly, to a display apparatus and a control method thereof, in which a moving picture and a still picture are displayed differently in a gradation level group.

2. Description of the Related Art

In a display apparatus that employs a time-sharing method for representing a gradation level, for example, in a plasma display panel (PDP), a digital mirror device (DMD), etc., there may be generated a false contour while the moving picture is displayed. Here, the false contour indicates a kind of afterimage due to a gradation level difference between a moving picture region and its adjacent region, wherein the gradation level difference is visually persisted and looks like a contour.

FIG. 1 is a schematic control block diagram of a conventional PDP in which the false contour of the moving picture is attenuated.

As shown therein, a conventional PDP comprises a reverse gamma correction part 101, a gradation level-limiting and error-diffusing part 102, a dither circuit 103, a motion detector 104, a selector 105, and a panel controller 106.

The reverse gamma correction part 101 changes an input video signal by the following equation (1). Here, the input video signal includes information about respective brightness levels of red, green and blue (RGB) data. Suppose that input and output brightness levels are represented as an integer, numerals to the right of a decimal point are an error of the brightness level.

$$Y=X^{2.2} \qquad \text{equation (1)}$$

(where, X is the input brightness level, and Y is the output brightness level)

The gradation level-limiting and error-diffusing part 102 reflects such error on the brightness of an adjacent pixel. That is, the brightness of the adjacent pixel is weighted with such error, and an error in the brightness of the adjacent pixel is reflected on the brightness information transmitted from the reverse gamma correction part 101.

A more significant function of the gradation level-limiting and error-diffusing part 102 is allowing the output of the reverse gamma correction part 101 to have the gradation level adapted to attenuate the false contour of the moving picture.

FIG. 2 is a table <Table 1> partially showing a gradation level representable by a weighted sub-field.

Referring to Table 1, the gradation level will be described in more detail.

One frame is divided into eight sub-fields sf1~sf8, and the sub-fields sf1~sf8 are weighted with the number of sustaining pulses 1, 2, 4, 8, . . . 128, respectively in sequence. Each gradation level is determined by a combination of luminance states of the sub-fields and is represented by a codeword, "1" as a luminance state and "0" as a non-luminance state. For example, the gradation level [3] is represented by a codeword of "11000000". At this time, the gradation level corresponding to the selected codeword is proportional to the total number of the sustaining pulses per which light is emitted during one frame.

In Table 1, "using gradation level" is a gradation level used in attenuating the false contour of the moving picture; "dither gradation level" together with "using gradation level" is a gradation level used in displaying the still picture; and "dither value" is an inherent value of the dither gradation level, which is equal to a gradation level difference between the moving picture region and its adjacent region. Thus, the gradation level representable by the sub-fields as illustrated in <Table 1> ranges from [0]~[255], but the gradation level corresponding to a predetermined codeword is selectively used.

In other words, the gradation level-limiting and error-diffusing part 102 limits the output of the reverse gamma correction part 101 to a predetermined gradation level group ("using gradation level"+"dither gradation level") for displaying the still picture, and diffuses all errors toward the adjacent pixels.

When an input gradation level is the dither gradation level, the dither circuit 103 outputs a corresponding dither value to the selector 105. Further, the motion detector 104 detects the motion of an image based on the input video signal and outputs its detection result to the selector 105.

When the motion detector 104 determines that the input video signal is used for the still picture, the selector 105 directly transmits the input gradation level from the dither circuit 103 to the following panel controller 106. On the other hand, when the input video signal is used for the moving picture, the selector 105 changes the input gradation level received from the dither circuit 103 into the using gradation level for displaying the moving picture.

For, example, when the video signal has a brightness level of [44], the gradation level-limiting and error-diffusing part 102 changes the gradation level into the dither gradation level [47] and diffuses the error as much as [3] to the adjacent pixels. Further, when the motion detector 104 determines that the video signal is used for the moving picture, the selector 105 adds the dither value to and subtracts the dither value from the dither gradation level, thereby changing the dither gradation level into an adjacent using gradation level. In particular, in the case of an even frame, the using gradation level is changed by adding the dither value to the dither gradation level, that is, [47]+[16]=[63]. Oppositely, in the case of an odd frame, the using gradation level is changed by subtracting the dither value from the dither gradation level, that is, [47]−[16]=[32]. Consequently, the using gradation level has an average gradation level of [47] in terms of time, thereby displaying a picture near to an original picture.

FIG. 3 is a table <Table 2> showing a using gradation level for displaying a moving picture.

As illustrated in <Table 2>, even if not many using gradation levels are employed for displaying the moving picture, it is possible to attenuate the false contour because the gradation levels of the moving picture are not represented in detail. Oppositely, the using gradation levels employed for displaying the still picture are enough to represent the gradation level in detail.

However, in the conventional display apparatus, if the gradation level difference between the adjacent gradation levels among the using gradation levels is relatively large, the gradation level difference between the dither gradation level and the adjacent using gradation level becomes larger, and therefore a flicker is likely to be frequently made. The reason why the flicker is frequently made is that the larger the gradation level difference between the dither gradation level and the adjacent using gradation level is, the more frequently the selector 105 changes the gradation level group according to whether the video signal is used for displaying the moving picture. Further, the gradation level difference between the dither gradation level and the adjacent using gradation level is unnaturally represented like noise in the adjacent pixels according as the error-diffusing part diffuses a large error. Here, the foregoing dithering method allows upper and lower adjacent gradation levels to be repeatedly changed therebetween with respect to a time-series frame, thereby increasing the flicker.

SUMMARY OF THE INVENTION

Accordingly, it is an aspect of the present general inventive concept to provide a display apparatus and a control method thereof, in which a video signal is represented by a gradation level group to attenuate a false contour and to prevent a flicker.

Additional aspects and advantages of the present general inventive concept will be set forth in part in the description which follows and, in part, will be obvious from the description, or may be learned by practice of the general inventive concept.

The foregoing and/or other aspects of the present general inventive concept are achieved by providing a display apparatus displaying a picture based on a video signal, comprising a moving picture determiner that determines whether the video signal is used for displaying a moving picture, a moving picture gradation level table that stores information about a moving picture gradation level group for displaying the moving picture, a still picture gradation level table that stores information about a still picture gradation level group including a predetermined number of gradation levels in consideration of a gradation level difference between the gradation levels of adjacent gradation levels in the case where the gradation level difference between the adjacent gradation levels of the moving picture gradation level group is larger than a predetermined reference gradation level difference, and a gradation level converter that converts the video signal to have the gradation level of the moving picture gradation level group or the still picture gradation level group according to results of the determination.

According to an aspect of the general inventive concept, the gradation level converter can include a gradation level setter that sets the video signal to have the gradation level of the still picture gradation level group, and a gradation level selector that selects the gradation level of the still picture gradation level group, which is set by the gradation level setter, to be outputted as being converted by a dithering method into the gradation level of the moving picture gradation level group when the moving picture determiner determines that the video signal is used for displaying the moving picture, and selects the gradation level of the still picture gradation level group to be outputted as being set by the gradation level setter when the moving picture determiner determines that the video signal is used for displaying the still picture.

According to another aspect of the general inventive concept, the gradation level selector may include a dither table that stores a predetermined pixel dither value corresponding to a pixel, and the still picture gradation level table stores a predetermined gradation level dither value corresponding to the gradation level of the still picture gradation level group, and the dithering method of the gradation level selector may include comparing the gradation level dither value of the still picture gradation level group set by the gradation level setter with the pixel dither value, and converting the gradation level of the still picture gradation level group, which is set by the gradation level setter, into one of two adjacent moving picture groups according to results of the comparison.

According to another aspect of the general inventive concept, the display may further include a display portion which receives sub-field code words represented as binary data including information about luminance of each pixel in each of a plurality of sub-fields time-sharing a frame of the video signal, and serially corresponding to the plurality of the sub-fields, receives a sustaining pulse that allows the pixels to illuminate, and makes brightness of the pixels have the gradation level in proportional to the number of the sustaining pulses per the frame.

According to another aspect of the general inventive concept, the moving and still picture gradation level tables store the sub-field code words for the moving picture gradation level group and the still picture gradation level group among the sub-field code words, respectively, and the display apparatus may further include a sub-field controller that provides the display portion with the sub-field code word of the gradation level tables corresponding to the gradation level converted by the gradation level converter.

According to another aspect of the general inventive concept, the display apparatus may further include a display portion which receives sub-field code words represented as binary data including information about luminance of each pixel in each of a plurality of sub-fields time-sharing a frame of the video signal and serially corresponding to the plurality of sub-fields, receives a sustaining pulse that allows the pixels to illuminate, and makes the brightness of the pixels have the gradation level in proportion to the number of the sustaining pulses per the frame.

According to yet another aspect of the general inventive concept, the moving and still picture gradation level tables store the sub-field code words for the moving picture gradation level group and the still picture gradation level group among the sub-field code words, respectively, and the display apparatus may further include a sub-field controller that provides the display portion with the sub-field code word of the gradation level tables corresponding to the gradation level converted by the gradation level converter.

The foregoing and/or other aspects of the general inventive concept may also be achieved by providing a method of controlling a display apparatus displaying a picture based on a video signal, the method including providing a moving picture gradation level table that stores information about a moving picture gradation level group for displaying the moving picture, and a still picture gradation level table that stores information about a still picture gradation level group including a predetermined number of gradation levels in consideration of a gradation level difference between the adjacent gradation levels of the moving picture gradation level group in a case where the gradation level difference between the adjacent gradation levels of the moving picture gradation level group is larger than a predetermined reference gradation level difference, determining whether the video signal is used for displaying a moving picture, and converting the video signal to have the gradation level of the moving picture gradation level group or the still picture gradation level group according to results of the determination.

According to another aspect of the general inventive concept, converting the video signal to have the gradation level according to the results of the determination may include setting a brightness level of a pixel depending on the video signal to have the gradation level of the still picture gradation level group, and converting the set gradation level of the still picture gradation level group into the gradation level of the moving picture gradation level group by a dithering method when it is determined that the video signal is used to display the moving picture.

According to another aspect of the general inventive concept, the method may further include providing a dither table that stores a predetermined pixel dither value corresponding to a pixel, and storing a predetermined gradation level dither value in the still picture gradation level table in correspondence to the gradation level of the still picture gradation level group, wherein the dithering method includes comparing the gradation level dither value with the pixel dither value, and converting the set gradation level of the still picture gradation level group into one of two adjacent gradation levels of the moving picture gradation level groups according to results of the comparison.

BRIEF DESCRIPTION OF THE DRAWINGS

The above and/or other aspects and advantages of the present general inventive concept will become apparent and more readily appreciated from the following description of the embodiments, taken in conjunction with the accompany drawings of which:

FIG. 2 is a table partially showing a gradation level representable by a weighted sub-field;

FIG. 3 is a table showing a using gradation level for displaying a moving picture;

FIG. 5 is a table showing gradation levels in which a proper number of middle gradation levels is randomly interposed between the using gradation levels.

DETAILED DESCRIPTION OF THE PREFERRED EMBODIMENTS

Figure 1:
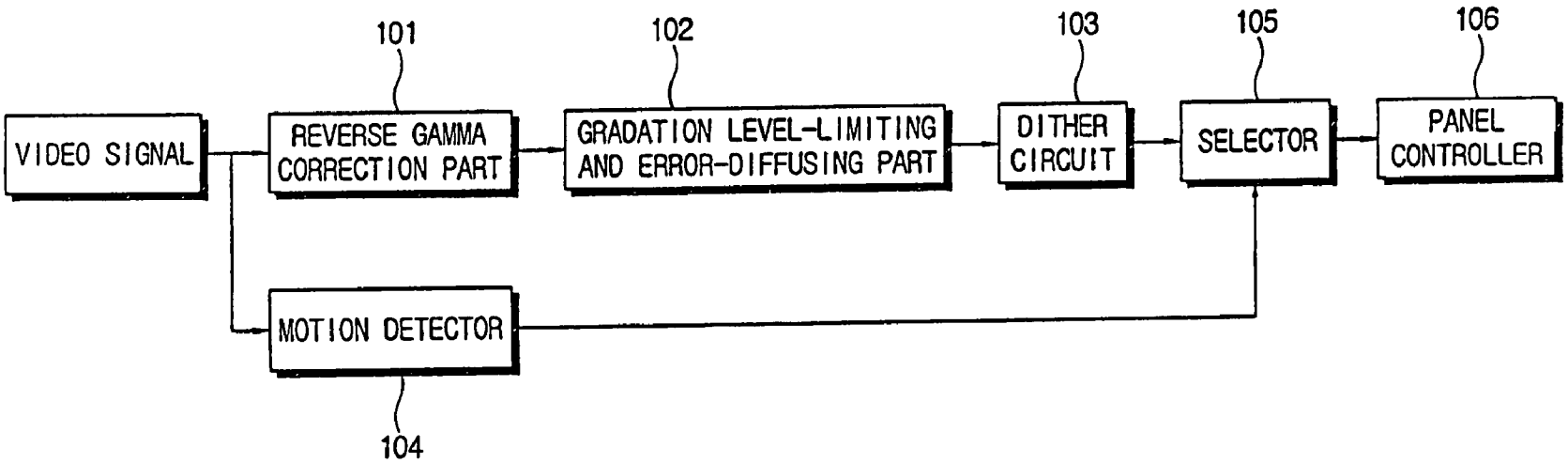
FIG. 1 (PRIOR ART)
FIG. 1 is a schematic control block diagram of a conventional PDP to attenuate a false contour of a moving picture.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

Figure 4:
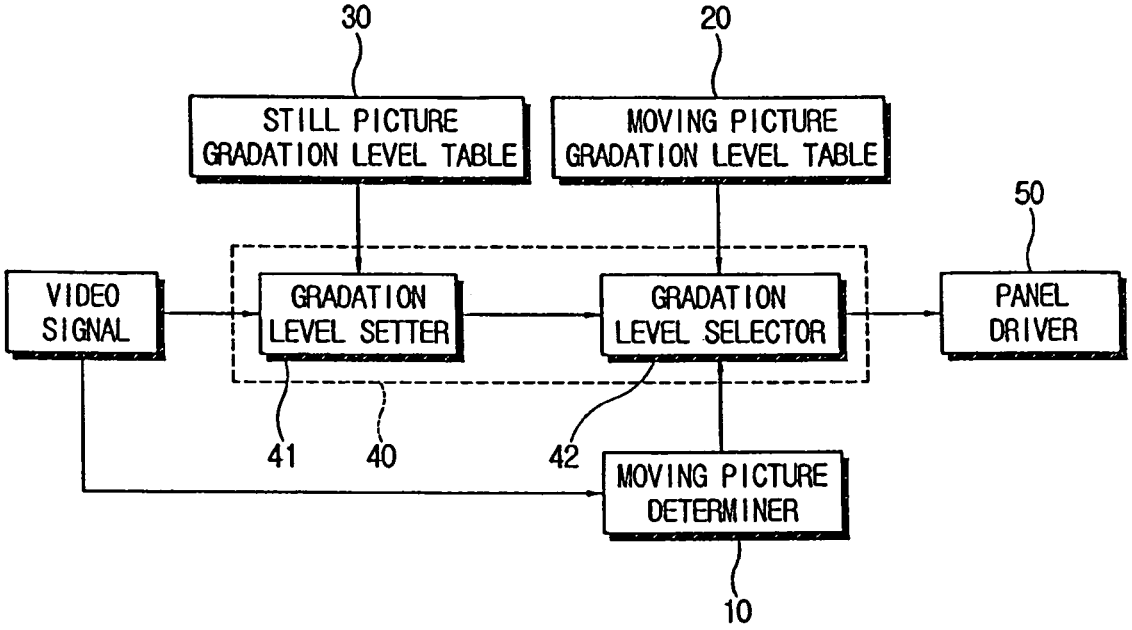
FIG. 4 is a control block diagram of a display apparatus according to an embodiment of the present general inventive concept.

FIG. 4 is a control block diagram of a display apparatus according to an embodiment of the present general inventive concept. As shown therein, the display apparatus may include a moving picture determiner 10, a moving picture gradation level table 20, a still picture gradation level table 30, a gradation level converter 40, and a panel driver 50.

The moving picture determiner 10 can determine whether an input video signal is displayed as a moving picture. As a determining method, there are used a motion estimation method that estimates a motion vector between a prior frame and a current frame per a block unit of a predetermined size, and a motion detection method that detects a picture data change of a pixel.

The moving picture gradation level table 20 stores information about a moving picture gradation level group for displaying a moving picture. The information about the moving picture gradation level group is different according to the display apparatuses, and can be stored by binary data such as a sub-field code word in the case of a display apparatus such as a PDP, a DMD, etc., that employs a time-sharing method of displaying a picture. Particularly, to attenuate a false contour, it is an aspect of the general inventive concept that a bit transition between adjacent gradation level code words among using gradation levels should be low, and the bit transition of the code word shown in Table 2 is limited to 1-bit.

The still picture gradation level table 30 stores information about a still picture gradation level group for displaying a still picture. Here, the still picture gradation level group includes a dither gradation level having several middle gradation levels in correspondence to a gradation level difference between adjacent gradation levels in the moving picture gradation level group.

For example, all representable gradation levels [0~255] shown in Table 1 can be employed as the still picture gradation level group. In this case, the still picture can be displayed in most detail, but the size of a processing block or a dither value (to be described later) for dithering an image is increased. Further, the middle gradation level may be provided to keep the gradation level difference between the middle gradation levels or between the middle gradation level and the using gradation level in a predetermined gradation level difference. Besides, as shown in FIG. 5, a proper number of the middle gradation levels can be randomly interposed between the using gradation levels.

The gradation level converter 40 can convert the gradation level of the video signal into one between the moving picture gradation level group and a still picture gradation level group according to the determination of the moving picture determiner 10, thereby outputting the converted gradation level to the panel driver 50. Further, the panel driver 50 allows each pixel to illuminate based on the gradation levels inputted per pixel.

According to an embodiment of the present general inventive concept, the dither gradation level of the still picture gradation level group, that is, the gradation level difference between the middle gradation level and the using gradation level of the moving picture gradation level group is small, thereby decreasing a flicker even if the using gradation level is changed. For example, a dither gradation level [191] between an upper limit gradation level [255] and a lower limit gradation level [127] has a gradation level difference, i.e., has a dither value of [64], so that a gradation level change corresponding to a gradation level of [64] causes the flicker. However, according to an embodiment of the present general inventive concept, a plurality of middle gradation levels having a gradation level difference of about [3] is provided in the still picture gradation level group, so that the gradation level can be changed between a minimum gradation level of [3] to a maximum gradation level of [64] even though the gradation level group is changed, thereby decreasing the flicker.

The gradation level converter 40 may include a gradation level setter 41 and a gradation level selector 42.

The gradation level setter 41 can set the video signal to have the gradation level of the still picture gradation level group. In the case of the PDP, there are provided a reverse gamma correction part, an error diffusing part, etc. Here, the gradation levels are densely provided in the still picture gradation level group, so that an error is not widely diffused by the error diffusing part.

The gradation level selector 42 receives the gradation level from the still picture gradation level group, and can select the output gradation level according to whether the video signal is used for displaying the moving picture. That is, when the moving picture determiner 10 determines that the video signal is used for displaying the still picture, the gradation level selector 42 selects the gradation level of the still picture gradation level group to be outputted as it is. In contrast, when the moving picture determiner 10 determines that the video signal is used for displaying the moving picture, the gradation level selector 42 selects the gradation level of the still picture gradation level group to be outputted as converted into the gradation level of the moving picture gradation level group.

Here, a dithering method according to an embodiment of the present general inventive concept can be used to convert the gradation level of the still picture gradation level group into the gradation level of the moving picture gradation level group.

According to this dithering method, the dither value of each middle gradation level is compared with a pixel dither value of each pixel, so that the gradation level of the still picture gradation level group is changed into the gradation level of one of the adjacent moving picture gradation level groups according to the size of the dither value.

For example, as illustrated in Table 3 of FIG. 5, the dither value of the dither gradation level can be set in an ascending order (1, 2, 3, . . . ) from the adjacent gradation level. The pixel dither value defines a luminance pattern in a predetermined region of an image based on the video signal. That is, to represent a predetermined gradation level in the region on average, the pixel to be illuminated is selected, and the pixel dither value can then be calculated by applying a weight proportional to the size of the gradation level to the selected pixel. To obtain the pixel dither values corresponding to the dither values of all gradation levels, the weight can be repeatedly applied to each pixel until all pixels are selected according to the size of the gradation level.

Such dithering method is very effective in preventing a conventional noise flicker due to the alternate selection between the upper and lower adjacent using gradation levels per frame.

Meanwhile, the control block diagram according an embodiment of the present general inventive concept may be achieved by software.

Figure 6:
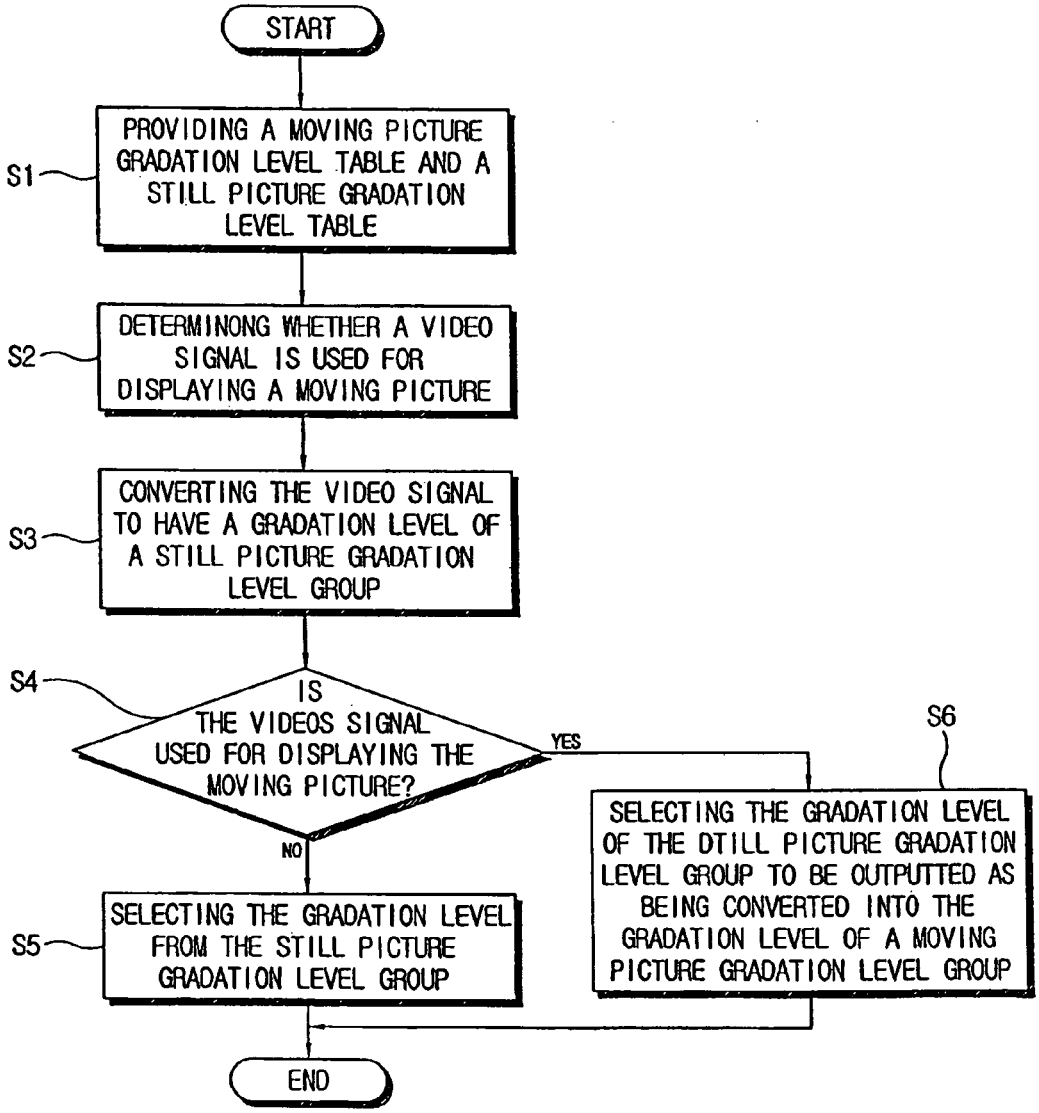
FIG. 6 is a control flow chart of a display apparatus according to another embodiment of the present general inventive concept.

FIG. 6 is a control flow chart of the display apparatus of FIG. 4, according to another embodiment of the present general inventive concept. Hereinbelow, a method of controlling a display apparatus according to another embodiment of the present invention will be described with reference to FIG. 6.

First, at operation S1, there is provided a moving picture gradation level table 20 storing information about the moving picture gradation level group, and a still picture gradation level table 30 storing information about the still picture gradation level group. Such gradation level tables may be stored as a table in a predetermined memory, and may include information about the code word or the number of sustaining pulses weighted with each sub-field in the case of the display apparatus employing the time-sharing method of processing the frame.

Then, at operation S2, it is determined whether the input video signal is used for displaying the moving picture. According to determination results, the input video signal is changed to have the gradation level of one of the gradation level groups.

Here, the process of allowing the video signal to have the gradation level can be divided as follows. First, at operation S3, a brightness level of each pixel based on the video signal is set as the gradation level of the still picture gradation level group. At operation S4, when it is determined that the video signal is used for displaying the still picture, at operation S5, the gradation level of the still picture gradation level group is outputted. In contrast, when it is determined that the video signal is used for displaying the moving picture, at operation S6, the gradation level of the still picture gradation level group is changed into the gradation level of the moving picture gradation level group by the dithering method and then outputted. Here, the dithering method may include the conventional dithering method.

As described above, the present general inventive concept provides a display apparatus and a control method thereof, in which a false contour of a moving picture is attenuated, and a flicker and a pixel noise are minimized.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A display apparatus that displays a picture based on a video signal, comprising:

a moving picture determiner that determines whether the video signal is used for displaying a moving picture;

a moving picture gradation level table that stores information about a moving picture gradation level group for displaying the moving picture;

a still picture gradation level table that stores information about a still picture gradation level group to display a still picture; and a gradation level converter that converts the video signal to have the gradation level of the moving picture gradation level group or the still picture gradation level group according to results of the determination, wherein a first number of first still picture gradation levels which exist between first adjacent gradation levels in the moving gradation level group is different from a second number of second still picture gradation levels which exist between second adjacent gradation levels in the moving gradation level group, and a gradation level difference between the first adjacent gradation levels is larger than a predetermined reference gradation level difference.

2. The display apparatus according to claim 1, wherein the gradation level converter comprises:

a gradation level setter that sets the video signal to have the gradation level of the still picture gradation level group; and a gradation level selector that selects the gradation level of the still picture gradation level group, which is set by the gradation level setter, to be outputted as being converted by a dithering method into the gradation level of the moving picture gradation level group when the moving picture determiner determines that the video signal is used for displaying the moving picture, and selects the gradation level of the still picture gradation level group to be outputted as being set by the gradation level setter when the moving picture determiner determines that the video signal is used for displaying the still picture.

3. The display apparatus according to claim 2, wherein the gradation level selector comprises a dither table that stores a predetermined pixel dither value corresponding to a pixel, and the still picture gradation level table stores a predetermined gradation level dither value corresponding to the gradation level of the still picture gradation level group, and the dithering method of the gradation level selector comprises comparing the gradation level dither value of the still picture gradation level group set by the gradation level setter with the pixel dither value; and converting the gradation level of the still picture gradation level group, which is set by the gradation level setter, into one of two adjacent moving picture groups according to results of the comparison.

4. The display apparatus according to claim 2, further comprising a display portion which receives sub-field code words represented as binary data including information about luminance of each pixel in each of a plurality of sub-fields time-sharing a frame of the video signal and serially corresponding to the plurality of sub-fields, receives a sustaining pulse for allowing the pixels to illuminate, and makes the brightness of the pixels have the gradation level in proportional to the number of the sustaining pulses per the frame.

5. The display apparatus according to claim 4, wherein the moving and still picture gradation level tables store the sub-field code words for the moving picture gradation level group and the still picture gradation level group among the sub-field code words, respectively, and the display apparatus further comprises a sub-field controller that provides the display portion with the sub-field codeword of the gradation level tables corresponding to the gradation level converted by the gradation level converter.

6. The display apparatus according to claim 1, further comprising a display portion which receives sub-field code words represented as binary data including information about luminance of each pixel in each of a plurality of sub-fields time-sharing a frame of the video signal, and serially corresponding to the plurality of the sub-fields, receives a sustaining pulse for allowing the pixels to illuminate, and makes brightness of the pixels have the gradation level in proportional to the number of the sustaining pulses per the frame.

7. The display apparatus according to claim 6, wherein the moving and still picture gradation level tables store the sub-field code words for the moving picture gradation level group and the still picture gradation level group among the sub-field code words, respectively, and the display apparatus further comprises a sub-field controller providing the display portion with the sub-field code word of the gradation level tables corresponding to the gradation level converted by the gradation level converter.

8. The display apparatus according to claim 1, wherein the moving picture determiner determines whether the video signal is used for displaying a moving picture by estimating a motion vector between a prior frame and a current frame per a block unit of a predetermined size.

9. The display apparatus according to claim 1, wherein the moving picture determiner determines whether the video signal is used for displaying a moving picture by detecting a picture data change of a pixel.

10. The display apparatus according to claim 1, wherein the first number of the first still picture gradation level which exists between first adjacent gradation levels in the moving gradation level group is larger than the second number of the second still picture gradation level which exists between second adjacent gradation levels.

11. A method of controlling a display apparatus displaying a picture based on a video signal, the method comprising:

providing a moving picture gradation level table storing information about a moving picture gradation level group for displaying the moving picture, and a still picture gradation level table storing information about a still picture gradation level group to display a still picture;

determining whether the video signal is used for displaying a moving picture; and converting the video signal to have the gradation level of the moving picture gradation level group or the still picture gradation level group according to results of the determination, wherein a first number of first still picture gradation levels which exist between first adjacent gradation levels in the moving gradation level group is different from a second number of second still picture gradation levels which exist between second adjacent gradation levels in the moving gradation level group, and a gradation level difference between the first adjacent gradation levels is larger than a predetermined reference gradation level difference.

12. The method according to claim 11, wherein the converting the video signal to have the gradation level according to the results of the determination comprises:

setting a brightness level of a pixel depending on the video signal to have the gradation level of the still picture gradation level group; and converting the set gradation level of the still picture gradation level group into the gradation level of the moving picture gradation level group by a dithering method when it is determined that the video signal is used for displaying the moving picture.

13. The method according to claim 12, further comprising:

providing a dither table storing a predetermined pixel dither value corresponding to a pixel; and storing a predetermined gradation level dither value in the still picture gradation level table in correspondence to the gradation level of the still picture gradation level group, wherein the dithering method comprises comparing the gradation level dither value with the pixel dither value, and converting the set gradation level of the still picture gradation level group into one of two adjacent gradation levels of the moving picture gradation level groups according to results of the comparison.

14. The method according to claim 11, wherein the first number of the first still picture gradation level which exists between first adjacent gradation levels in the moving gradation level group is larger than the second number of the second still picture gradation level which exists between second adjacent gradation levels.

15. A method to display a picture based on a video signal, the method comprising:

determining whether the video signal is used for displaying a moving picture;

storing information about a moving picture gradation level group for displaying the moving picture;

storing information about a still picture gradation level group for displaying a still picture; and converting the video signal to have the gradation level of the moving picture gradation level group or the still picture gradation level group according to results of the determination, wherein a first number of first still picture gradation levels which exist between first adjacent gradation levels in the moving gradation level group is different from a second number of second still picture gradation levels which exist between second adjacent gradation levels in the moving gradation level group, and a gradation level difference between the first adjacent gradation levels is larger than a predetermined reference gradation level difference.

16. The method according to claim 15, where the converting comprises:

setting the video signal to have the gradation level of the still picture gradation level group; and selecting the set gradation level of the still picture gradation level group to be outputted as being converted by a dithering method into the gradation level of the moving picture gradation level group when the determining operation determines that the video signal is used for displaying the moving picture, and selecting the gradation level of the still picture gradation level group to be outputted as being set when the determining operation determines that the video signal is used for displaying the still picture.

17. The method according to claim 15, wherein the first number of the first still picture gradation level which exists between first adjacent gradation levels in the moving gradation level group is larger than the second number of the second still picture gradation level which exists between second adjacent gradation levels.

18. A non-transitory storage medium storing a method to display a picture based on a video signal, the method comprising:

determining whether the video signal is used for displaying a moving picture;

storing information about a moving picture gradation level group for displaying the moving picture;

storing information about a still picture gradation level group for displaying a still picture; and converting the video signal to have the gradation level of the moving picture gradation level group or the still picture gradation level group according to results of the determination, wherein a first number of first still picture gradation levels which exist between first adjacent gradation levels in the moving gradation level group is different from a second number of second still picture gradation levels which exist between second adjacent gradation levels in the moving gradation level group, and a gradation level difference between the first adjacent gradation levels is larger than a predetermined reference gradation level difference.

19. The non-transitory storage medium according to claim 18, wherein the method further comprises:

setting the video signal to have the gradation level of the still picture gradation level group; and selecting the set gradation level of the still picture gradation level group to be outputted as being converted by a dithering method into the gradation level of the moving picture gradation level group when the determining operation determines that the video signal is used for displaying the moving picture, and selecting the gradation level of the still picture gradation level group to be outputted as being set when the determining operation determines that the video signal is used for displaying the still picture.

20. The non-transitory storage medium according to claim 18, wherein the first number of the first still picture gradation level which exists between first adjacent gradation levels in the moving gradation level group is larger than the second number of the second still picture gradation level which exists between second adjacent gradation levels.

21. A non-transitory storage medium storing a method of controlling a display apparatus displaying a picture based on a video signal, the method comprising:

providing a moving picture gradation level table storing information about a moving picture gradation level group for displaying the moving picture, and a still picture gradation level table storing information about a still picture gradation level group for displaying a still picture;

determining whether the video signal is used for displaying a moving picture; and converting the video signal to have the gradation level of the moving picture gradation level group or the still picture gradation level group according to results of the determination, wherein a first number of first still picture gradation levels which exist between first adjacent gradation levels in the moving gradation level group is different from a second number of second still picture gradation level which exist between second adjacent gradation levels in the moving gradation level group, and a gradation level difference between the first adjacent gradation levels is larger than a predetermined reference gradation level difference.

22. The non-transitory storage medium of claim 21, wherein the method further comprises:

setting a brightness level of a pixel depending on the video signal to have the gradation level of the still picture gradation level group; and converting the set gradation level of the still picture gradation level group into the gradation level of the moving picture gradation level group by a dithering method when it is determined that the video signal is used for displaying the moving picture.

23. The non-transitory storage medium of claim 22, wherein the method further comprises:

providing a dither table storing a predetermined pixel dither value corresponding to a pixel; and storing a predetermined gradation level dither value in the still picture gradation level table in correspondence to the gradation level of the still picture gradation level group, wherein the dithering method comprises comparing the gradation level dither value with the pixel dither value, and converting the set gradation level of the still picture gradation level group into one of two adjacent gradation levels of the moving picture gradation level groups according to results of the comparison.

24. The non-transitory storage medium according to claim 21, wherein the first number of the first still picture gradation level which exists between first adjacent gradation levels in the moving gradation level group is larger than the second number of the second still picture gradation level which exists between second adjacent gradation levels.

25. A method to display a picture based on a video signal, the method comprising:

receiving a still picture gradation level table having information for a still picture gradation level group for displaying a still picture;

receiving a moving picture gradation level table having information for a moving picture gradation level group for displaying a moving picture where a gradation level difference between adjacent gradation levels of the moving picture gradation level group is larger than a predetermined reference gradation level difference;

determining a result of whether the video signal is used for displaying a still picture or a moving picture;

converting the video signal to have a gradation level of a still picture gradation level group or a motion picture gradation level group based on the determined result; and outputting a converted gradation level for display, wherein a first number of first still picture gradation levels which exist between first adjacent gradation levels in the moving gradation level group is different from a second number of second still picture gradation levels which exist between second adjacent gradation levels in the moving gradation level group, and a gradation level difference between the first adjacent gradation levels is larger than a predetermined reference gradation level difference.

26. The method according to claim 25, wherein the first number of the first still picture gradation level which exists between first adjacent gradation levels in the moving gradation level group is larger than the second number of the second still picture gradation level which exists between second adjacent gradation levels.

27. A display apparatus that displays a picture based on a video signal, comprising:

a moving picture determiner to determine a result of whether the video signal is used for displaying a moving picture;

a storage unit to store a still picture gradation level table having information for a still picture gradation level group for displaying a still picture and a moving picture gradation level table having information about a moving picture gradation level group for displaying the moving picture, where a gradation level difference between adjacent gradation levels of the moving picture gradation level group is larger than a predetermined reference gradation level difference;

a gradation level converter that converts the video signal to have the gradation level of the moving picture gradation level group or the still picture gradation level group according to a received result from the motion picture determiner; and a display driver to output a converted gradation level for display, wherein a first number of first still picture gradation levels which exist between first adjacent gradation levels in the moving gradation level group is different from a second number of second still picture gradation level which exist between second adjacent gradation levels in the moving gradation level group, and a gradation level difference between the first adjacent gradation levels is larger than a predetermined reference gradation level difference.

28. The display apparatus according to claim 27, wherein the first number of the first still picture gradation level which exists between first adjacent gradation levels in the moving gradation level group is larger than the second number of the second still picture gradation level which exists between second adjacent gradation levels.

* * * * *